US009435329B2

(12) United States Patent
Kitagawa et al.

(10) Patent No.: US 9,435,329 B2
(45) Date of Patent: Sep. 6, 2016

(54) AIR COMPRESSOR

(75) Inventors: Hiroki Kitagawa, Hitachinaka (JP); Tomoyoshi Yokota, Hitachinaka (JP); Kenichi Matsunaga, Hitachinaka (JP); Masahiro Miura, Hitachinaka (JP); Shingo Kosugi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 451 days.

(21) Appl. No.: 13/585,708

(22) Filed: Aug. 14, 2012

(65) Prior Publication Data

US 2013/0042605 A1 Feb. 21, 2013

(30) Foreign Application Priority Data

Aug. 18, 2011 (JP) ..... 2011-178884

(51) Int. Cl.
*F04B 41/02* (2006.01)
*F04B 35/06* (2006.01)

(52) U.S. Cl.
CPC ..... *F04B 35/06* (2013.01); *F04B 41/02* (2013.01)

(58) Field of Classification Search
CPC ..... F04B 35/06; F04B 41/02
USPC ..... 417/234, 36; 60/417, 410
See application file for complete search history.

(56) References Cited

U.S. PATENT DOCUMENTS 6,331,101 B2 * 12/2001 Leu et al. ..... 417/423.14
6,447,257 B2 9/2002 Orschell
6,450,436 B1 * 9/2002 Tsuji et al. ..... 242/400.1
7,163,382 B1 1/2007 Stilwell et al.
7,832,991 B2 11/2010 Wood et al.
8,282,363 B2 * 10/2012 Ohi et al. ..... 417/234
8,784,070 B2 * 7/2014 Yokota et al. ..... 417/44.2
8,814,535 B2 * 8/2014 Etter et al. ..... 417/234
2001/0009646 A1 7/2001 Leu et al.
2002/0009371 A1 * 1/2002 Orschell ..... 417/201
2002/0096411 A1 7/2002 Tsuji et al.
2004/0028535 A1 * 2/2004 Brashears et al. ..... 417/234
2006/0067836 A1 * 3/2006 Smith et al. ..... 417/234

(Continued)

FOREIGN PATENT DOCUMENTS

CN 1368839 A 9/2002
CN 1536225 A 10/2004

(Continued)

OTHER PUBLICATIONS

JP3699297 Machine Translation.*

(Continued)

*Primary Examiner* — Nathaniel Wiehe
*Assistant Examiner* — Dustin T Nguyen
(74) *Attorney, Agent, or Firm* — Kilpatrick Townsend & Stockton LLP

(57) ABSTRACT

An air compressor includes a compression unit, a drive unit, a tank unit, and a control circuit unit. The compression unit is configured to generate a compressed air and provided with a handle positioned above a center of gravity of the air compressor. The drive unit is configured to drive the compression unit. The tank unit is disposed below the compression unit and includes a plurality of air tanks configured to reserve the compressed air. The compressed air reserved in the tank unit has a pressure value. The control circuit unit is configured to detect the pressure value of the compressed air reserved in the tank unit and to control the drive unit to drive the compression unit.

12 Claims, 4 Drawing Sheets

(56) References Cited

U.S. PATENT DOCUMENTS

| | | | | |
|---|---|---|---|---|
| 2008/0044296 | A1 | 2/2008 | Wood et al. | |
| 2008/0112823 | A1* | 5/2008 | Yoshida et al. | 417/410.1 |
| 2009/0016902 | A1* | 1/2009 | Lee et al. | 417/234 |
| 2010/0090087 | A1 | 4/2010 | Maier | |
| 2011/0182754 | A1* | 7/2011 | Gathers et al. | 417/234 |

FOREIGN PATENT DOCUMENTS

| | | | | | |
|---|---|---|---|---|---|
| CN | 101943159 | A | | 1/2011 | |
| JP | 55-104786 | U | | 1/1979 | |
| JP | 2001-003869 | A | | 1/2001 | |
| JP | 2004-218514 | A | | 8/2004 | |
| JP | 3699297 | | * | 7/2005 | F04B 41/02 |
| JP | 3699297 | B2 | | 9/2005 | |
| JP | 4010249 | B2 | | 11/2007 | |
| JP | 2010-059917 | A | | 3/2010 | |
| JP | WO2010/041774 | | * | 4/2010 | 417/44.2 |

OTHER PUBLICATIONS

Japan Patent Office office action for patent application JP2011-178884 (Feb. 19, 2015).

Chinese Patent Application No. 2012102974377, The Notification of the First Office Action, mailed Sep. 6, 2015 along with English translation.

* cited by examiner

AIR COMPRESSOR

CROSS REFERENCE TO RELATED APPLICATION

This application claims priority from Japanese Patent Application No. 2011-178884 filed Aug. 18, 2011. The entire content of the priority application is incorporated herein by reference.

TECHNICAL FIELD

The present invention relates to an air compressor to supply compressed air to a power tool whose power source is compressed air.

BACKGROUND

A multistage air compressor disclosed in Japanese Unexamined Patent Application Publication No. 2010-059917 includes a drive unit, a low-pressure side compression unit, a high-pressure side compression unit, an air tank, and a joint. The low-pressure side compression unit and the high-pressure side compression unit are connected to each other. Each of the low-pressure side compression unit and the high-pressure side compression unit is adapted to be driven by the drive unit, such as a motor, and to generate compressed air. The air tank is adapted to reserve the compressed air generated by the high-pressure side compression unit. The joint has a decompression valve for decompressing the compressed air reserved in the air tank, so that the compressed air can be taken off from the air tank. In this type of air compressor, a socket is connected to the joint to discharge the compressed air to a pneumatically operated fastener driving tool.

Such an air compressor serves as a power source for a pneumatic tool mainly used in construction work. Normally, two types of air compressor are available. One is used in a work site where a relatively great amount of air is consumed. This type of air compressor includes two or more air tanks and two or more handles, and the user needs to carry the air compressor with both hands. Another is generally used for a pneumatic tool for interior work. This type of air compressor includes a single air tank, and is compact and lightweight. The user can carry the air compressor with a single hand.

SUMMARY

In general, such a portable type air compressor is used at an interior work site in a high story building. When working in the high story building, the user needs to ascend stairs while carrying the air compressor. In view of portability, the air compressor has compact and lightweight configuration. For making the air compressor compact and lightweight, downsizing of the compression unit, the drive unit, and the air tank is attained. Hence, the portable type air compressor can reserve only a small amount of compressed air in the air tank and also discharge only a small amount of compressed air from the air tank. For this reason, at actual work, an amount of compressed air consumable by the pneumatic tool is limited. Continuous operation of the pneumatic tool causes pressure drop of the compressed air in the air tank, which requires reactivation of the drive unit. Reactivation of the drive unit requires longer waiting time to refill the compressed air in the air tank. Therefore, work efficiency of the portable type air compressor is occasionally reduced.

In view of the foregoing, it is an object of the present invention to provide a portable type air compressor with improved work efficiency.

In order to attain the above and other objects, the present invention provides an air compressor including a compression unit, a drive unit, a tank unit, and a control circuit unit. The compression unit is configured to generate a compressed air and provided with a handle positioned above a center of gravity of the air compressor. The drive unit is configured to drive the compression unit. The tank unit is disposed below the compression unit and includes a plurality of air tanks configured to reserve the compressed air. The compressed air reserved in the tank unit has a pressure value. The control circuit unit is configured to detect the pressure value of the compressed air reserved in the tank unit and to control the drive unit to drive the compression unit.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
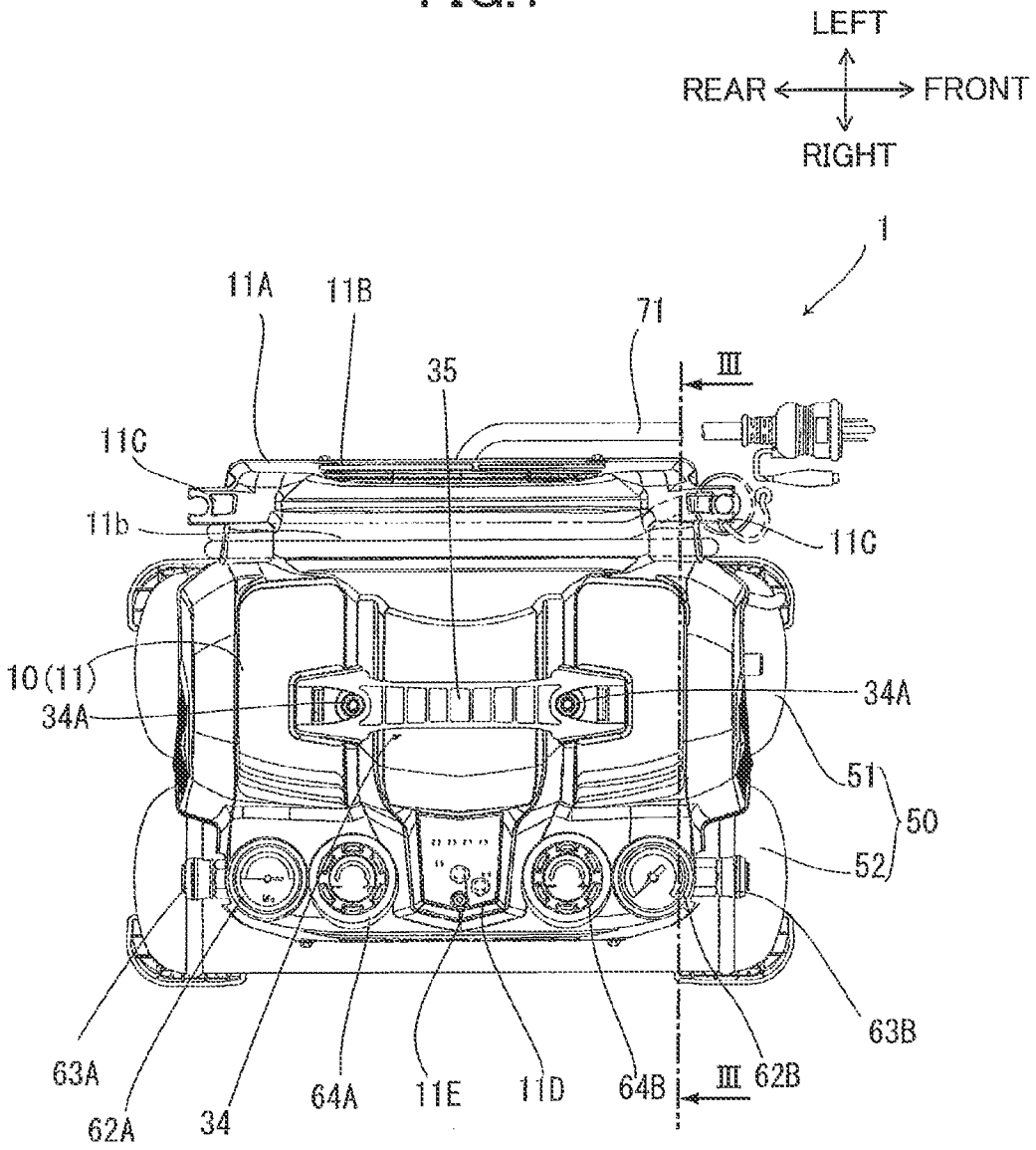
FIG. 1 is a plan view of an air compressor according to one embodiment of the present invention provided with a cover.

An air compressor according to one embodiment of the present invention will be described while referring to FIGS. 1 through 4 wherein like parts and components are designated by the same reference numerals to avoid duplicating description.

Figure 2:
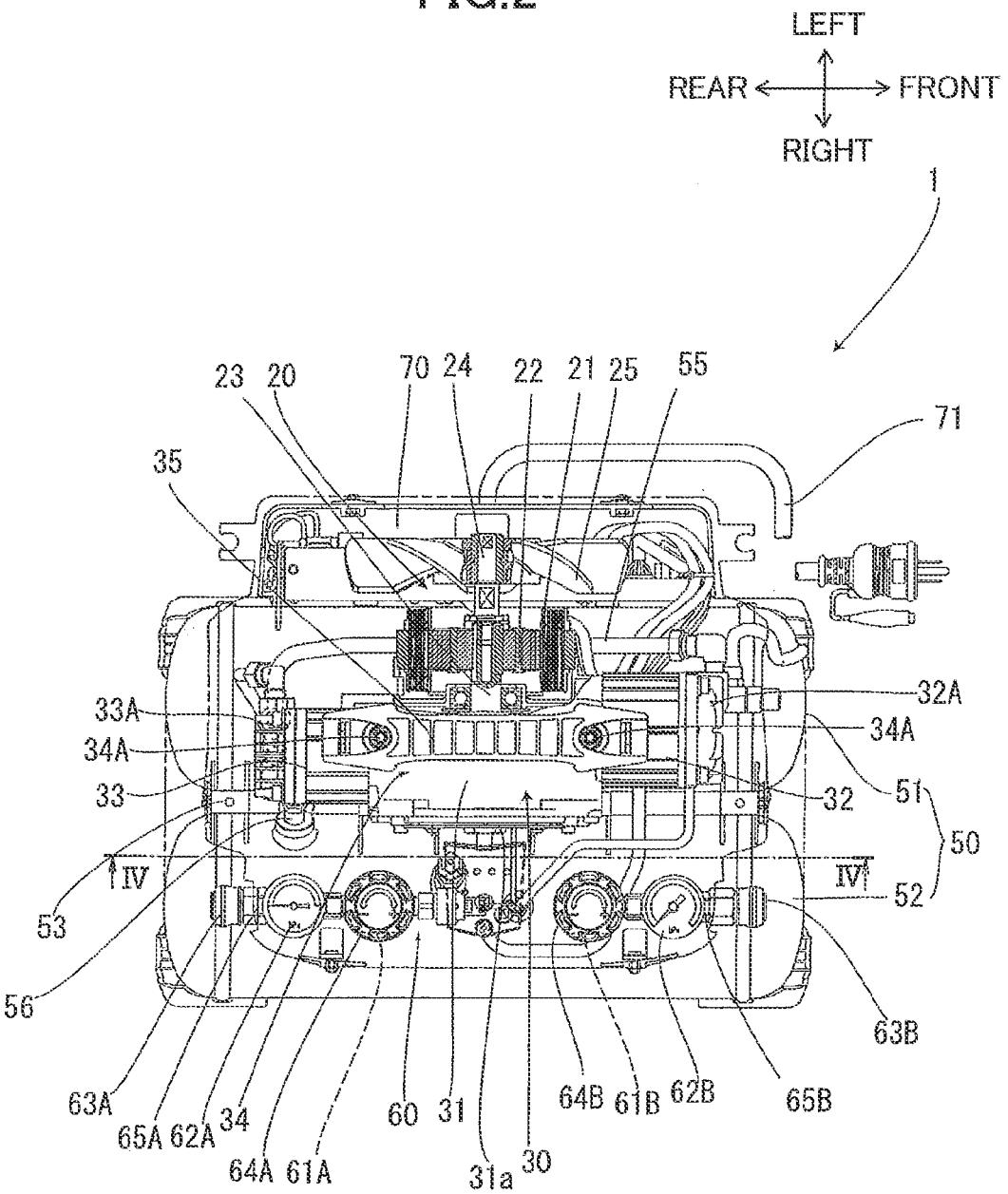
FIG. 2 is a plan view of the air compressor according to the embodiment, from which the cover is omitted.

The portable type air compressor 1 serves to supply compressed air to a pneumatic tool such as a pneumatically operated fastener driving tool. The total weight of the air compressor 1 is approximately 12.9 kg. The air compressor 1 is capable of supplying one hundred and ten (110) liters per minute of 0.7 MPa compressed air with a maximum pressure of 4.4 MPa. As shown in FIGS. 1 and 2, the air compressor 1 includes a cover 10, a drive unit 20, a compression unit 30, a tank unit 50, a valve unit 60, and a control circuit unit 70.

In the following description, the terms "upward", "downward", "upper", "lower", "above", "below", "beneath", "right", "left", "front", "rear" and the like will be used assuming that the air compressor 1 is disposed in an orientation in which it is intended to be used. More specifically, left, right, top, and bottom sides in FIG. 1 are rear, front, left, and right sides of the air compressor 1. Further, near and far sides in FIG. 1 are top and bottom sides of the air compressor 1.

Figure 3:
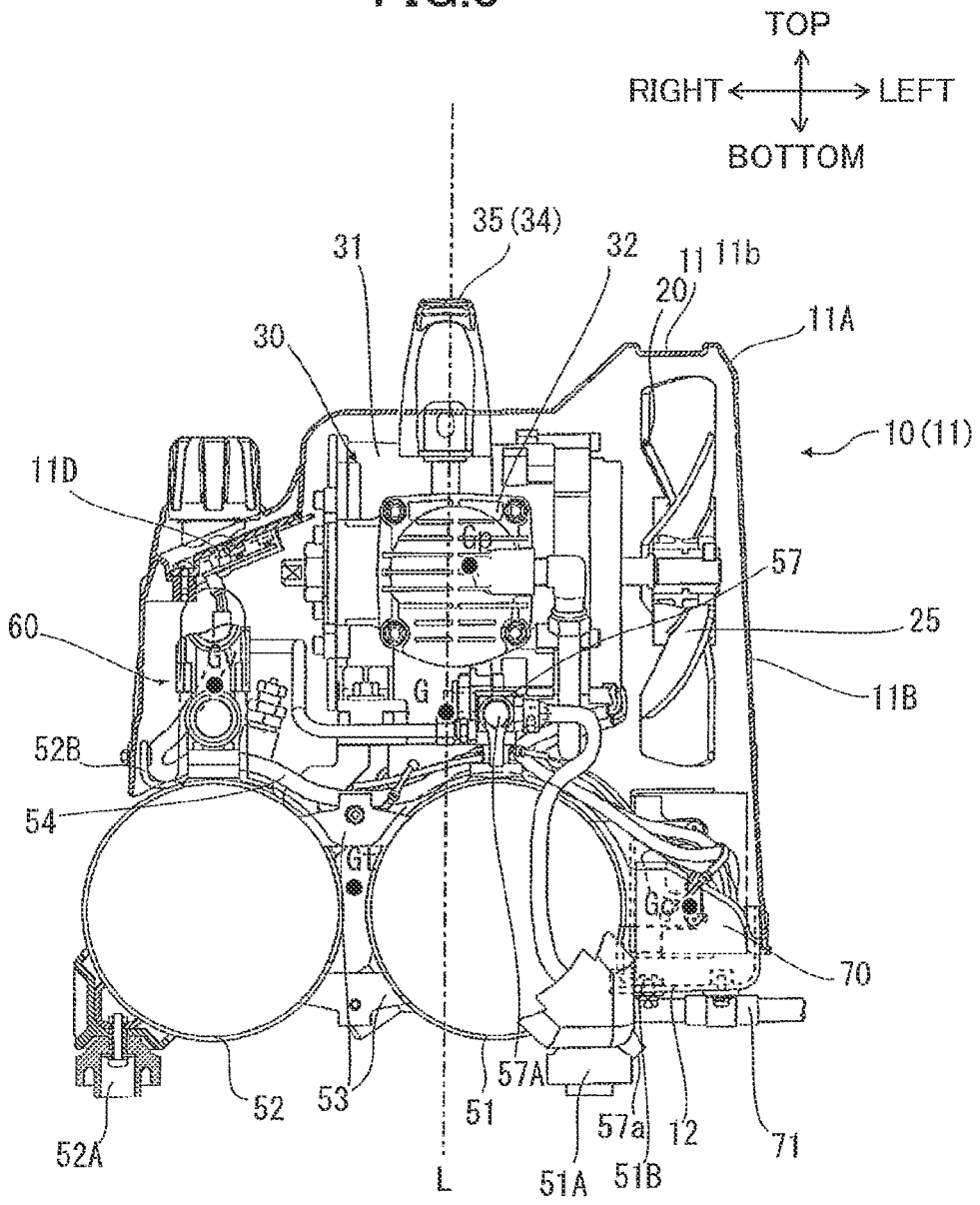
FIG. 3 is a cross-sectional view of the air compressor according to the embodiment along a line III-III shown in FIG. 1.

As shown in FIG. 3, the tank unit 50 includes a pair of air tanks 51 and 52, a pair of frames 53, a communication pipe 54, and a drain discharge device 57. The pair of air tanks 51 and 52 is configured to reserve compressed air generated in the compression unit 30. Each of the air tanks 51 and 52 has a hollow cylindrical configuration with its axis oriented in the frontward/rearward direction (axial direction). In other words, the tanks 51 and 52 are elongated in the frontward/rearward direction (an elongated direction). Each of the air tanks 51 and 52 has closed axial ends. The air tanks 51 and 52 are disposed such that the axes thereof are arranged parallel to each other. That is, the air tanks 51 and 52 are juxtaposed with each other in a rightward/leftward direction that is perpendicular to the axial direction. More specifically, the air tank 51 is disposed leftward of the air tank 52. The pair of air tanks 51 and 52 is supported to the pair of frames 53 so as to be fixed to each other, as shown in FIG. 3. The interior of the air tank 51 is in communication with the interior of the air tank 52 via the communication pipe 54.

As shown in FIG. 3, the air tank 51 has a lower front end and a lower rear end, each provided with a vibration-isolating rubber foot 51A. Likewise, the air tank 52 has a lower front end and a lower rear end, each provided with a vibration-isolating rubber foot 52A. Two of the rubber foots 51A and two of the rubber foots 52A are located at four corners of the air compressor 1, respectively. The rubber foots 51A and the rubber foots 52A are contactable with the ground when the air compressor 1 is installed on the ground. Since the rubber foots 51A and the rubber foots 52A are provided at the four corners of the air compressor 1, rollover of the air compressor 1 can be restrained.

Further, as shown in FIG. 3, the drain discharge device 57 is disposed above the air tank 51. The drain discharge device 57 is provided with a drain cock 57A and a drain discharge port 57*a*. A user manually operates the drain cock 57A to selectively open and close the drain cock 57A. The drain discharging device 57 is configured such that, when the drain cock 57A is opened, drain and compressed air reserved in the air tanks 51 and 52 can be simultaneously discharged from the drain discharge port 57*a* through the communication pipe 54 and a flow passage formed in the drain discharging device 57.

As shown in FIG. 3, the air tank 51 has a lower left portion at which a cover fixing portion 51B is provided. The cover fixing portion 51B extends leftward from the air tank 51. Likewise, the air tank 52 has an upper right portion at which a cover fixing portion 52B is provided. The cover fixing portion 52B extends upward from the air tank 52. Further, the air tank 51 has an upper portion at which a pair of crank-cover fixing portions 51C (FIG. 4) is provided. The drive unit 20 and the compression unit 30 are fixed to the pair of crank-cover fixing portions 51C. The crank-cover fixing portions 51C are arrayed in the frontward/rearward direction.

The total weight of the tank unit 50 is approximately 3.0 kg. The total volume of the pair of air tanks 51 and 52 is approximately eight (8) liters. Further, the tank unit 50 has a center of gravity Gt (FIG. 3). The center of gravity Gt is positioned at a center of the air compressor 1 in the frontward/rearward direction. The center of gravity Gt is also positioned between the air tanks 51 and 52 in the rightward/leftward direction.

As shown in FIG. 3, the drive unit 20 for driving the compression unit 30 is disposed above the air tank 51. Further, as shown in FIG. 2, the drive unit 20 is disposed at a substantially center of the air compressor 1 in the frontward/rearward direction. The drive unit 20 is fixed to the air tank 51 and the pair of frames 53. The drive unit 20 is configured of a three-phase AC brushless motor. The drive unit 20 includes a stator 21, a rotor 22, and an output shaft 23 that is rotatable integrally with the rotor 22. The drive unit 20 is disposed inside a crank casing 31 (described later) such that an axis of the output shaft 23 is oriented in the rightward/leftward direction. The output shaft 23 has a left end to which a rotation shaft 24 is fixed. The rotation shaft 24 is coaxial with the output shaft 23. An axial flow fan 25 is fixed to the rotation shaft 24 and coaxial with the rotation shaft 24. The axial flow fan 25 is rotatable integrally with the rotation shaft 24. Further, the output shaft 23 has a right end that extends through the crank casing 31 (described later).

As shown in FIG. 3, the compression unit 30 for generating a compressed air is disposed above the air tank 51. In other words, the tank unit 50 is disposed below the compression unit 30. Further, as shown in FIG. 2, the compression unit 30 is disposed at a substantially center of the air compressor 1 in the frontward/rearward direction. The compression unit 30 is fixed to the air tank 51 and the pair of frames 53. The compression unit 30 is disposed rightward of the drive unit 20. The compression unit 30 includes the crank casing 31 that is fixed to the pair of crank-cover fixing portions 51C and upper one of the pair of frames 53. The crank casing 31 defines a crank chamber (not shown) therein. Within the crank chamber, the compression unit 30 further includes a crank shaft (not shown) and a crank arm (not shown). The compression unit 30 further includes a first compressor 32, and a second compressor 33. The first compressor 32 includes a first piston (not shown) and a first cylinder (not shown), for generating a compressed air. Likewise, the second compressor 33 includes a second piston (not shown) and a second cylinder (not shown), for generating a compressed air.

The crank shaft (not shown) and the crank arm (not shown) are disposed inside the crank casing 31. The crank shaft (not shown) is rotatable integrally with the output shaft 23 of the drive unit 20. Further, the crank shaft (not shown) is drivingly connected to the first piston (not shown) and the second piston (not shown) via the crank arm (not shown). The crank shaft (not shown) is adapted to convert rotation movement of the output shaft 23 of the drive unit 20 to reciprocating movement of the first piston (not shown) of the first compressor 32 and the second piston (not shown) of the second compressor 33.

The first compressor 32 extends frontward from the crank casing 31. The first compressor 32 includes the first cylinder (not shown) in which the first piston (not shown) and a first connecting rod (not shown) connecting the first piston (not shown) to the crank arm (not shown) are provided. The first compressor 32 serves as a low-pressure side compression unit. The first compressor 32 has a front end portion at which a first cylinder head 32A is provided. A first valve seat (not shown) is provided at a position between the first cylinder head 32A and the first cylinder (not shown). The first valve seat (not shown) is provided with a first inlet port (not shown) and a first outlet port (not shown).

The second compressor 33 extends rearward from the crank casing 31. The second compressor 33 includes the second cylinder (not shown) in which the second piston (not shown) and a second connecting rod (not shown) connecting the second piston (not shown) to the crank arm (not shown) are provided. The second compressor 33 serves as a high-pressure side compression unit. The second compressor 33 has a rear end portion at which a second cylinder head 33A is provided. A second valve seat (not shown) is provided at a position between the second cylinder head 33A and the second cylinder (not shown). The second valve seat (not shown) is provided with a second inlet port (not shown) and a second outlet port (not shown).

The first outlet port is connected to the second inlet port via a tubular member 55, and the second outlet port is connected to the air tank 52 via a tubular member 56.

Figure 4:
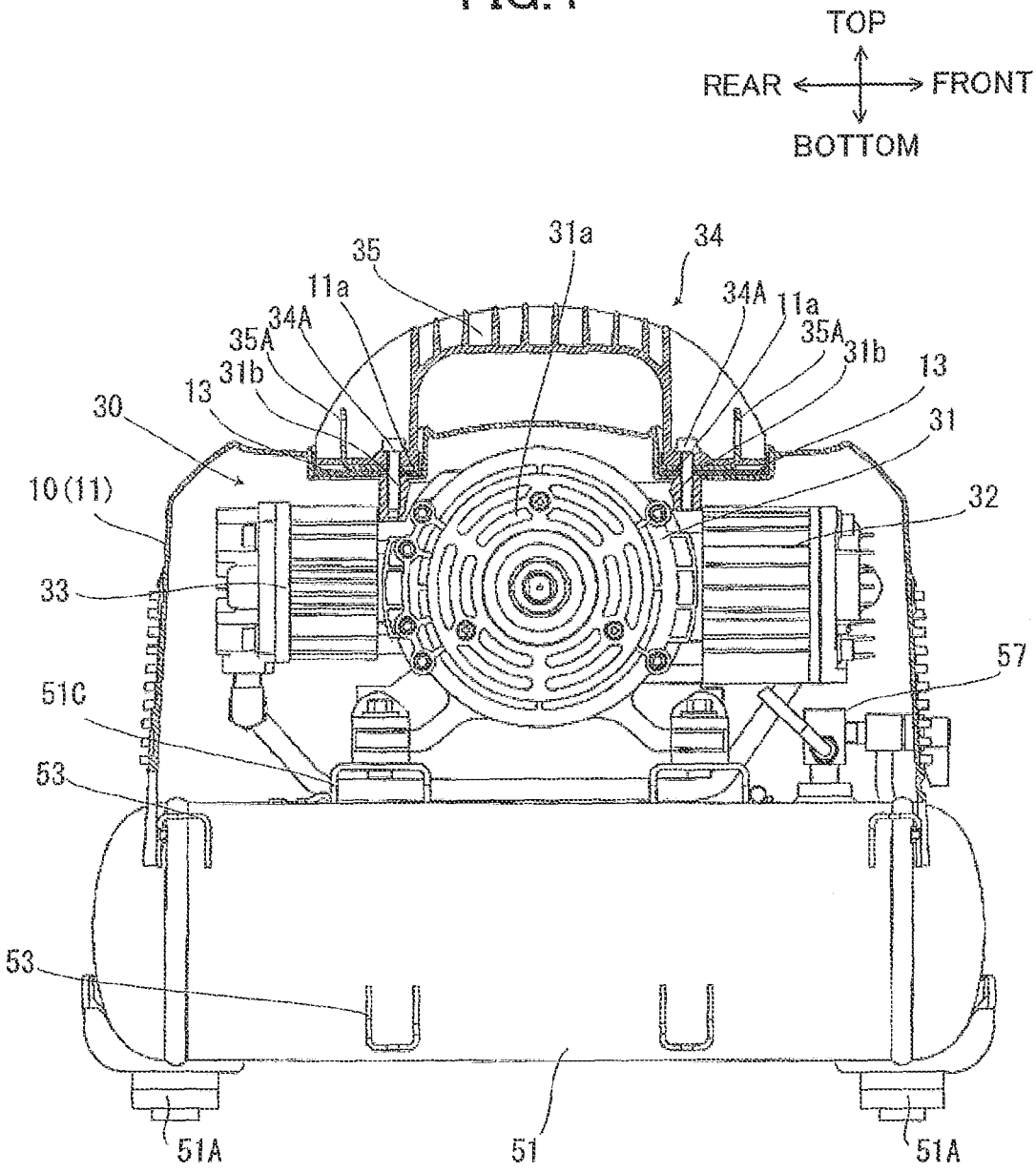
FIG. 4 is a cross-sectional view of the air compressor according to the embodiment along a line IV-IV shown in FIG. 2.

As shown in FIGS. 2 and 4, the crank casing 31 has a right side wall provided with an air intake port 31*a* for providing communication between the interior and exterior of the crank casing 31. The air intake port 31*a* is disposed opposite to the axial flow fan 25 with respect to the drive unit 20 and the crank casing 31. That is, the air intake port 31*a* does not face the axial flow fan 25. Accordingly, airflow generated by the axial flow fan 25 does not directly impinge on a portion of the crank casing 31 where the air intake port 31*a* is formed.

As shown in FIG. 4, the crank casing 31 has a top wall formed with a pair of screw holes 31*b*. One of the pair of screw holes 31*b* is disposed at a position where the crank casing 31 and the first compressor 32 are connected to each other, and remaining one of the pair of screw holes 31*b* is disposed at a position where the crank casing 31 and the second compressor 33 are connected to each other. Two of the screw holes 31*b* are arrayed in the frontward/rearward direction.

The compression unit 30 further includes a handle unit 34. The handle unit 34 includes a handle 35, a pair of engaged portions 35A, a pair of screws 34A. Each of the pair of screws 34A is threadingly engageable with each of the pair of screw holes 31*b*. The handle 35 is fixed to the crank casing 31 through threading engagement of the pair of screws 34A with the pair of screw holes 31*b*, interposing the first cover 11 between the handle 35 and the crank casing 31. At this time, the handle 35 is oriented so as to extend in the frontward/rearward direction.

Each of the pair of engaged portions 35A is fixed to the handle 35 by each of the pair of screws 34A. The pair of engaged portions 35A is adapted to hold a shoulder belt (not shown) and the like. The handle 35 is positioned at a substantially center of the air compressor 1 in the frontward/rearward direction.

The drive unit 20 and the compression unit 30 has a total weight ranging approximately from 5.7 kg to 5.9 kg. Further, the drive unit 20 and the compression unit 30 have a center of gravity Gp (FIG. 3). The center of gravity Gp is positioned at the center of the air compressor 1 in the frontward/rearward direction. The center of gravity Gp is also positioned leftward of a dashed line L (FIG. 3) in the rightward/leftward direction. The dashed line L is a straight line drawn from the handle 35 in the vertical direction.

As shown in FIG. 2, the valve unit 60 includes decompression valves 61A and 61B, pressure gauges 62A and 62B, couplers 63A and 63B, pressure regulation handles 64A and 64B, and socket holders 65A and 65B. More specifically, a set of the decompression valve 61A, the pressure gauge 62A, the coupler 63A, the pressure regulation handle 64A, and the socket holder 65A is disposed above a rear portion of the air tank 52 and rightward of the compression unit 30. Further, a set of the decompression valve 61B, the pressure gauge 62B, the coupler 63B, the pressure regulation handle 64B, and the socket holder 65B is disposed above a front portion of the air tank 52 and rightward of the compression unit 30.

The decompression valve 61A is adapted to decompress compressed air reserved in the air tanks 51 and 52 so that the compressed air has a pressure suitable for being taken off from the coupler 63A. This pressure can be regulated by the pressure regulation handle 64A. The socket holder 65A is threadingly engaged with the decompression valve 61A, the coupler 63A, and the pressure gauge 62A. The coupler 63A is adapted to be connected to a pneumatically operated fastener driving tool via a hose to supply compressed air to the pneumatic tool. The pressure of compressed air taken off from the coupler 63A can be monitored through the pressure gauge 62A.

Likewise, the decompression valve 61B is adapted to decompress compressed air reserved in the air tanks 51 and 52 so that the compressed air has a pressure suitable for being taken off from the coupler 63B. This pressure can be regulated by the pressure regulation handle 64B. The socket holder 65B is threadingly engaged with the decompression valve 61B, the coupler 63B, and the pressure gauge 62B. The coupler 63B is adapted to be connected to a pneumatically operated fastener driving tool via a hose to supply compressed air to the pneumatic tool. The pressure of compressed air taken off from the coupler 63B can be monitored through the pressure gauge 62B.

With the above-described configuration of the valve unit 60, regardless of intensity of the pressure of compressed air introduced into the air tanks 51 and 52, the pressure of compressed air at the coupler 63A can be regulated at a fixed pressure value by the pressure regulation handle 64A so that the fixed pressure value is less than or equal to the maximum pressure value. As a result, compressed air with a pressure value less than or equal to the maximum pressure value can be obtained through the coupler 63A.

Likewise, the pressures of compressed air at the coupler 63B can be regulated at a fixed pressure value by the pressure regulation handle 64B so that the fixed pressure value are less than or equal to the maximum pressure value. As a result, compressed air with a pressure value less than or equal to the maximum pressure value can be obtained through the coupler 63B.

The weight of the valve unit 60 is approximately 1.0 kg. The valve unit 60 has a center of gravity Gv (FIG. 3). The center of gravity Gv is positioned at the center of the air compressor 1 in the frontward/rearward direction. The center of gravity Gv is also positioned at the center of the valve unit 60 in the rightward/leftward direction.

The control circuit unit 70 is configured to detect the pressure value of the compressed air reserved in the tank unit 50 and to control the drive unit 20 to switch the drive unit 20 on and off. As shown in FIG. 3, the control circuit unit 70 is disposed below the axial flow fan 25 and leftward of the air tank 51. The control circuit unit 70 includes an electric cord 71 having a tip end portion connectable to an external power source for driving the drive unit 20. The weight of the control circuit unit 70 is approximately 0.9 kg. The control circuit unit 70 has a center of gravity Gc (FIG. 3). The center of gravity Gc is positioned at the center of the air compressor 1 in the frontward/rearward direction. The center of gravity Gc is also positioned at the center of the control circuit unit 70 in the rightward/leftward direction.

The drive unit 20, the compression unit 30, the tank unit 50, the valve unit 60, and the control circuit unit 70 constitute a main unit of the air compressor 1. The main unit has a center of gravity G (FIG. 3).

The center of gravity Gp of the drive unit 20 and the compression unit 30, the center of gravity Gt of the tank unit 50, the center of gravity Gv of the valve unit 60, and the center of gravity Gc of the control circuit unit 70 are respectively positioned at the center of the air compressor 1 in the frontward/rearward direction. The center of gravity G of the main unit is therefore positioned at the center of the air compressor 1 in the frontward/rearward direction.

The center of gravity Gp of the drive unit 20 and the compression unit 30, the center of gravity Gt of the tank unit 50, the center of gravity Gv of the valve unit 60, and the center of gravity Gc of the control circuit unit 70 are respectively positioned at different locations in the rightward/leftward direction. However, the center of gravity G of the main unit is positioned in the vicinity of the dashed line L in the rightward/leftward direction, which is calculated based on the respective locations of the center of gravity Gp, the center of gravity Gt, the center of gravity Gv, and the center of gravity Gc in the rightward/leftward direction and also based on the respective weights of the drive unit 20, the compression unit 30, the tank unit 50, the valve unit 60, and the control circuit unit 70.

Further, the center of gravity G is positioned below the center of gravity Gp of the drive unit 20 and the compression unit 30, and above the tank unit 50 in the vertical direction.

As shown in FIG. 3, the cover 10 includes a first cover 11, a second cover 12, and elastic members 13 (FIG. 4). The first cover 11 is made of resin. The first cover 11 mainly covers the drive unit 20, the compression unit 30, and the valve unit 60. In other words, the cover 10 is configured to cover at least a part of the compression unit 30. The first cover 11 is fixed to the cover fixing portion 52B. The first cover 11 is also fixed to a top edge of the second cover 12. The first cover 11 is provided such that a gap is formed between the drive unit 20 and the compression unit 30, and the first cover 11.

As shown in FIG. 4, the first cover 11 has a top wall formed with a pair of through-holes 11*a* above the compression unit 30. The pair of through-holes 11*a* allow the handle 35 to extend therethrough and position outside of the first cover 11. The pair of screws 34A is also capable of extending through the pair of through-holes 11*a* via the screw holes 31*b*. Each of the pair of through-holes 11*a* has a shape such that a gap is formed between a part of the crank casing 31 that is positioned on the periphery of each of the screw holes 31*b* and a part of the first cover 11 that is positioned on the periphery of each of the pair of through-holes 11*a*, and such that a gap is also formed between the handle 35 and the part of the cover 11 that is positioned on the periphery of each of the pair of through-holes 11*a*. That is, the first cover 11 and compression unit 30 defines a gap therebetween.

As shown in FIG. 3, the first cover 11 has a left portion at which a projecting portion 11A is provided. The projecting portion 11A projects leftward so that the axial flow fan 25 can be accommodated therein. In other words, the projecting portion 11A projects in a projecting direction crossing the frontward/rearward direction and the vertical direction that is directed from the compression unit 30 to the tank unit 50. The projecting portion 11A has a left side planar wall 11B extending in the vertical direction and in the frontward/rearward direction. The left side wall 11B has a grid-like configuration. That is, the left side wall 11B is formed with a plurality of through-holes for introducing outside air into the cover 10 in association with rotation of the axial flow fan 25.

Further, the first cover 11 has a reel portion 11*b* at an outer circumference of the projecting portion 11A. The reel portion 11*b* serves as a portion for guiding the electric cord 71 in the frontward/rearward direction and in the vertical direction to permit the electric cord 71 to be looped around the reel portion 11*b*. More specifically, the reel portion 11*b* is formed with combination of a groove formed in a top surface of the projecting portion 11A and extending in the frontward/rearward direction, a groove formed in a front surface of the projecting portion 11A and extending in the vertical direction, and a groove formed in a rear surface of the projecting portion 11A and extending in the vertical direction. The projecting portion 11A and the second cover 12 are assembled such that the electric cord 71 can be looped around the reel portion 11*b* and the second cover 12.

Further, as shown in FIG. 1, the first cover 11 has a pair of holders 11C for holding the electric cord 71. The pair of holders 11C is disposed adjacent to the left side wall 11B at the outer circumference of the projecting portion 11A. More specifically, one of the pair of holders 11C is disposed at a front portion of the projecting portion 11A and remaining one of the pair of holders 11C is disposed at a rear portion of the projecting portion 11A.

As shown in FIG. 1, on the top wall of the first cover 11, an operation panel 11D having a main power switch 11E is provided. The main power switch 11E is adapted to switch on and off a commercial three-phase AC power supply provided in the air compressor 1. Power supply to the drive unit 20, the control circuit unit 70, and the like is rendered on and shut off through the main power switch 11E. Further, the main power switch 11E is also adapted to display pressure values of compressed air reserved in the air tanks 51 and 52, and warning sings such as overload.

The weight of the cover 10 is approximately 0.9 kg. The cover 10 is relatively lightweight. The cover 10 is adapted to cover the main unit. Hence, the air compressor 1 has a center of gravity at a position corresponding to the location of the center of gravity G of the main unit.

The second cover 12 is formed of metal. The second cover 12 is fixed to the cover fixing portion 51B and extends upward therefrom. The second cover 12 is adapted to mainly protect the control circuit unit 70. The first cover 11 is supported to the top edge of the second cover 12.

The elastic member 13 is made of resin, such as rubber and sponge. As shown in FIG. 4, two of the elastic members 13 are interposed between the first cover 11 and the handle 35. That is, the elastic members 13 are interposed between the first cover 11 and the compression unit 30. More specifically, one of the elastic members 13 is positioned in the vicinity of the position where the first compressor 32 is connected to the crank casing 31 via the front side of the handle 35, and remaining one of the elastic members 13 is positioned in the vicinity of the position where the second compressor 33 is connected to the crank casing 31 via the rear end of the handle 35.

Because the elastic members 13 are interposed between the first cover 11 and the handle 35 at positions where the first cover 11 and the handle 35 are adjacent to each other, direct contact between the first cover 11 and the handle 35 can be restrained. In other words, because the elastic members 13 are interposed between the first cover 11 and the compression unit 30 at positions where the first cover 11 and the compression unit 30 are adjacent to each other, direct contact between the first cover 11 and the compression unit 30 can be restrained.

Next, an air compressing operation of the air compressor 1 with the above-described configuration will be described. When the air compressor 1 is in operation, air flows into the cover 10 through the plurality of through-holes formed in the first cover 11. Then, the air flows into the crank casing 31 through the air intake port 31*a* in association with the reciprocating movement of the first piston in the first cylinder provided in the first compressor 32. Subsequently, the air flows into the first cylinder through the first inlet port formed in the first valve seat of the first compressor 32. The air is compressed in the first cylinder so as to have a pressure value ranging from 0.7 to 0.8 MPa. The compressed air is taken off from the first outlet port formed in the first valve seat of the first compressor 32 to flow into the second cylinder provided in the second compressor 33 through the second inlet port formed in the second valve seat of the second compressor 33 via the tubular member 55. The compressed air is further compressed in the second cylinder so as to have a pressure value ranging from 3.0 to 4.5 MPa, that is, the allowable maximum pressure value. The compressed air in the second compressor 33 is taken off from the second outlet port formed in the second valve seat of the second compressor 33 to flow into the air tank 52 through the tubular member 56. The compressed air introduced into the air tank 52 partly flows into the air tank 51 via the communication pipe 54. Hence, the compressed air is reserved both in the air tank 51 and in the air tank 52 at the same pressure.

When the user carries the air compressor 1 with the above-described configuration, the user holds the handle 35 such that the air compressor 1 is positioned rightward of the user, and lifts up the air compressor 1. That is, the left side wall 11B of the air compressor 1 is in confrontation with or in contact with the user from a right side thereof. Further, at this time, the electric cord 71 is looped around the reel portion 11*b*, and a tip end of the electric cord 71 is held by either the front holder 11C or the rear holder 11C.

The center of gravity G of the main unit is positioned immediately vertically downward of the handle 35. In other words, the handle 35 is positioned above the center of gravity G. Therefore, even though the user carries the air compressor 1 with the single handle 35, the air compressor 1 can be held stably. Hence, the air compressor 1 can be easily carried, and portability of the air compressor 1 can be improved.

Further, the compression unit 30 has the heaviest weight among the units constituting the main unit of the air compressor 1. Since the handle unit 34 is provided in the compression unit 30, the center of gravity G of the main unit is positioned adjacent to the handle unit 34. Therefore, when the air compressor 1 is lifted up with the handle 35, postural instability of the air compressor 1 can be restrained.

Further, the cover 10 is fixed not to the compression unit 30 but to the tank unit 50 in the main unit of the air compressor 1. Further, the cover 10 is configured such that a gap is formed between the compression unit 30 and the cover 10, and a gap is also formed between the handle unit 34 assembled to the compression unit 30 and the cover 10. The compression unit 30 is provided with the first piston (not shown) and the second piston (not shown) which generate vibration. The above-described configuration can restrain the compression unit 30 from directly transmitting vibration to the cover 10.

Further, the elastic members 13 are provided at positions where the first cover 11 and the handle 35 are adjacent to each other. The first cover 11 is in contact with the handle 35 with the elastic members 13 interposed therebetween, and the first cover 11 is in contact with the compression unit 30 with the elastic members 13 interposed therebetween. Vibration transmitted to the handle 35 from the compression unit 30 can be absorbed by the elastic members 13, and thus, vibration transmitted to the handle 35 from the compression unit 30 can be prevented from being further transmitted to the first cover 11. The elastic members 13 are disposed at a top portion of the air compressor 1 and away from the center of gravity G of the main unit. Therefore, the elastic members 13 have a higher vibration absorption effect, which attains vibration reduction. Hence, noise reduction and longer service life can also be attained.

The left side wall 11B of the cover 10 is positioned in confrontation with or in contact with the user's body when the user carries the air compressor 1. The left side wall 11B is formed in a planar shape. Therefore, the left side wall 11B is closely contactable with the user's body. Accordingly, when the user holds the handle 35 with his/her right hand to carry the air compressor 1, the left side wall 11B is brought into contact with the user's body. As a result, the air compressor 1 can be held by the user in a stable state.

Further, the handle unit 34 is provided with the engaged portions 35A for attaching the shoulder belt thereto. When the user puts the shoulder belt attached to the handle unit 34 on his/her shoulder to carry the air compressor 1, the user can stably carry the air compressor 1, without holding the handle 35, by bringing the left side wall 11B into close contact with the user's body.

Further, the reel portion 11*b* is disposed at a position not in contact with the user's body when the user carries the air compressor 1. The electric cord 71 is looped around the reel portion 11*b*, and also the tip end portion of the electric cord 71 is held in the holder 11C. Therefore, when the user carries the air compressor 1, the reel portion 11*b* restrains the electric cord 71 from disturbing the user. Further, the holder 11C prevents the electric cord 71 from being loosened from the reel portion 11*b*.

While the present invention has been described in detail with reference to the embodiment thereof, it would be apparent to those skilled in the art that various changes and modifications may be made therein without departing from the scope of the present invention.

For example, the drive unit 20 is configured of the three-phase AC power brushless motor in the above-described embodiment. However, the drive unit 20 may be configured of other types of motor.

In the above-described embodiment, the tank unit 50 includes the two air tanks 51 and 52. However, the number of air tanks provided in the tank unit 50 is not limited to two. The tank unit 50 may include a plurality of air tanks more than two.

In the above-described embodiment, the first cover 11 is fixed to the tank unit 50. However, the first cover 11 may be fixed to at least one of the drive unit 20, the tank unit 50, and the control circuit unit 70, other than the compression unit 30.

In the above-described embodiment, the control circuit unit 70 includes the electrical code 71. However, the drive unit 20 may be provided with a code to be looped around the reel portion 11*b*.

What is claimed is:

1. An air compressor comprising:

a compression unit configured to generate a compressed air and provided with a handle positioned directly above a center of gravity of the air compressor, the compression unit including a first compressor and a second compressor that are arranged in a first direction, the handle having a first end portion and a second end portion disposed downstream of the first end portion in the first direction, the first end portion being connected to the first compressor, and the second end portion being connected to the second compressor;

a drive unit including an output shaft configured to drive first compressor and the second compressor, the output shaft extending in a second direction intersecting with the first direction;

a tank unit elongated in the first direction and disposed below the compression unit, the tank unit being configured to reserve the compressed air, the compressed air reserved in the tank unit having a pressure value, the tank unit including a first tank and a second tank; and a control circuit unit configured to detect the pressure value of the compressed air reserved in the tank unit and to control the drive unit to drive the compression unit, the first tank being disposed between the control circuit unit and the second tank in the second direction, wherein the center of gravity of the air compressor is disposed below the output shaft and above the tank unit.

2. The air compressor as claimed in claim 1, further comprising a cover configured to cover at least a part of the compression unit, the cover being fixed to at least one of the drive unit, the tank unit, and the control circuit unit, and other than the compression unit.

3. The air compressor as claimed in claim 2, wherein the cover is formed with a through-hole above the compression unit; and wherein the handle extends through the through-hole and is positioned outside of the cover.

4. The air compressor as claimed in claim 2, wherein the cover and the compression unit define a gap therebetween.

5. The air compressor as claimed in claim 2, further comprising an elastic member disposed between the cover and the compression unit.

6. The air compressor as claimed in claim 2, wherein the drive unit is configured to be driven by an external power source, at least one of the control circuit unit and the drive unit being provided with a cord having a tip end portion connectable with the external power source;

wherein the cover is provided with a projecting portion projecting in a projecting direction crossing the first direction and a vertical direction that is directed from the compression unit to the tank unit, the projecting portion including a planar surface extending in direction and in the vertical direction and a reel portion configured to guide the cord in the first direction and in the vertical direction to permit the cord to be looped around the reel portion.

7. The air compressor as claimed in claim 6, wherein the tank unit has a first side and a second side disposed downstream of the first side in the first direction; and wherein the projecting portion has an upstream side portion and a downstream side portion disposed downstream of the upstream side portion in the first direction;

wherein the cover is provided with a holder on at least one of the downstream side portion and the upstream side portion and configured to hold the tip end portion of the cord.

8. The air compressor as claimed in claim 2, wherein the cover is provided with a reel portion around which an electric cord can be looped, the reel portion being positioned closer to the control circuit unit than to the second tank.

9. The air compressor as claimed in claim 1, wherein the center of gravity of the air compressor is positioned between the center of gravity of the tank unit and the center of gravity of the compression unit.

10. The air compressor as claimed in claim 9, wherein:

the first tank, the second tank, and the compression unit are disposed so as to define a substantial triangle when viewed in the first direction; and the center of gravity of the air compressor is positioned within the substantial triangle.

11. The air compressor as claimed in claim 1, wherein:

the first compressor has a first cylinder head;

the second compressor has a second cylinder head; and the handle is separated from the first cylinder head and the second cylinder head.

12. The air compressor as claimed in claim 1, further comprising:

a first engaged portion and a second engaged portion configured to hold a shoulder belt, the first engaged portion being closer to the first end portion than to the second end portion, the second engaged portion being closer to the second end portion than to the first end portion; and a first screw and a second screw, the first engaged portion and the first end portion of the handle being fixed to the first compressor by the first screw, the second engaged portion and the second end portion of the handle being fixed to the second end portion by the second screw.

* * * * *